United States Patent [19]

Ginzburg et al.

[11] Patent Number: 4,513,594

[45] Date of Patent: Apr. 30, 1985

[54] METHOD AND APPARATUS FOR COMBINING AUTOMATIC GAUGE CONTROL AND STRIP PROFILE CONTROL

[75] Inventors: Vladimir B. Ginzburg, Pittsburgh; Sidney R. Snitkin, Leechburg, both of Pa.

[73] Assignee: Tippins Machinery Company, Inc., Pittsburgh, Pa.

[21] Appl. No.: 525,327

[22] Filed: Aug. 22, 1983

[51] Int. Cl.[3] ..... B21B 37/06; B21B 37/08

[52] U.S. Cl. ..... 72/8; 72/17; 72/20; 72/21; 72/205

[58] Field of Search ..... 72/8, 205, 21, 17, 19, 72/20, 10, 11

[56] References Cited

U.S. PATENT DOCUMENTS

| | | | |
|---|---|---|---|
| 3,387,470 | 6/1968 | Smith, Jr. | 72/21 X |
| 3,394,566 | 7/1968 | O'Brien | 72/8 |
| 3,518,858 | 7/1970 | Kamata | 72/19 |
| 3,531,961 | 10/1970 | Dunn | 72/8 |
| 3,574,280 | 4/1971 | Smith, Jr. | 72/21 |
| 3,587,263 | 6/1971 | McCarthy | 72/8 |
| 3,714,805 | 2/1973 | Stone | 72/19 X |
| 3,855,830 | 12/1974 | Kitanosono et al. | 72/8 |
| 4,016,735 | 4/1977 | Peterson | 72/17 X |
| 4,187,707 | 2/1980 | Quehen | 72/8 |

*Primary Examiner*—Lowell A. Larson
*Assistant Examiner*—Steven B. Katz
*Attorney, Agent, or Firm*—Webb, Burden, Robinson & Webb

[57] ABSTRACT

The method of combining automatic gauge control and strip profile control in a tandem rolling mill comprises detecting a signal representative of the actual roll separating force in a first tandem stand and utilizing that signal to maintain a constant roll force in that stand through interstand tension control within predetermined limits and where the tension limit would be exceeded utilizing the signal to simultaneously control the roll gap for gauge control and control the roll bending for strip profile control in the first stand. The interstand tension is controlled either through the speed control of the first stand and/or the gap control of a downstream stand or through a combined tension control loop which initially adjusts tension through an interstand looper and thereafter adjusts the interstand looper to a set point through speed control of the first stand.

9 Claims, 3 Drawing Figures

METHOD AND APPARATUS FOR COMBINING AUTOMATIC GAUGE CONTROL AND STRIP PROFILE CONTROL

FIELD OF THE INVENTION

Our invention relates to method and apparatus for combining automatic gauge control and strip profile control in a tandem rolling mill. More particularly, our method relates to a combined control system which uses a single roll separating force signal as the process variable. Exit gauge and strip profile of a stand are controlled primarily through constant roll force. To maintain constant roll force, interstand tension is adjusted until an established limit is reached. Thereafter, the gap is adjusted so as to maintain gauge with an associated change in roll bending pressure to maintain constant crown to thickness ratios in spite of the eventual force changes.

BRIEF DESCRIPTION OF THE PRIOR ART

It is well known in the rolling mill art to provide automatic gauge control for adjusting the gap (no load) formed by the working rolls to maintain a constant strip thickness. The most common system includes a gauge meter which compares the actual roll separating force with a reference roll separating force and thereafter makes a gap correction based on the relationship of $$\delta = h - (F/K_S)$$

where $\delta$ is gap, h is thickness, F is roll separating force and $K_S$ is mill spring constant.

It is also known to utilize roll bending to compensate for increases in roll force so as to maintain the crown to thickness ratio as a constant. While a number of forms of roll bending have been applied, they all basically utilize a bending moment which has a direction and a magnitude so as to oppose and compensate for deflections of the working rolls at the roll gap caused by changes in the particular forces on the rolls.

Finally, it is known to utilize understand tension control as a means to reduce the actual roll separating force of the mill. Interstand tension can be controlled by altering the speed of the upstream mill stand, changing the gap setting of the downstream mill stand or by utilizing interstand looper rolls which alter the position of the strip in a vertical direction.

While all of the above systems have been used independently, there remains a need for a rapidly responsive combined system which achieves optimum gauge and strip profile control under dynamic conditions without sacrificing any of the positive attributes of each of the independently known systems.

SUMMARY OF THE INVENTION

Our invention combines automatic gauge control and strip profile control into a single dynamic system. This is accomplished through the utilization of a single correction signal representative of the difference between an actual roll separating force (also referred to as "roll force") and a reference roll separating force. All adjustments are made with the objective of reducing the magnitude of the correction signal to maintain constant roll force without changing the no-load roll gap thereby not disrupting strip gauge or profile. Where it is necessary to make a change in roll force for gauge control that change is compensated by a change in roll bending pressure to maintain constant strip profile.

Our invention includes a method of detecting a signal representative of the actual roll separating force in an upstream stand and utilizing that signal to maintain a constant roll force in the upstream stand through interstand tension control within predetermined limits and where the limit would be exceeded utilizing that signal to simultaneously control the roll gap for gauge control and control the roll bending for strip profile control. A tension control loop can either control the speed of one of the mill stands and/or the gap setting of the downstream roll stand or control the interstand looper roll by initially adjusting the pressure on the looper roll to change its position with respect to a set point and thereafter adjusting the speed of one of the mill stands so as to return the looper roll to the set point. Once the tension limit is reached, strip thickness is controlled through a gauge meter control of the cylinder. Strip profile, as defined by a constant strip thickness to crown ratio, is controlled through roll bending.

DESCRIPTION OF THE PREFERRED EMBODIMENTS

For simplification purposes, our invention is shown in conjunction with a single pair of roll stands in a tandem mill although it will be recognized that such a system is equally applicable to a greater number of four high roll stands having roll bending and gauge control capabilities.

Figure 1:
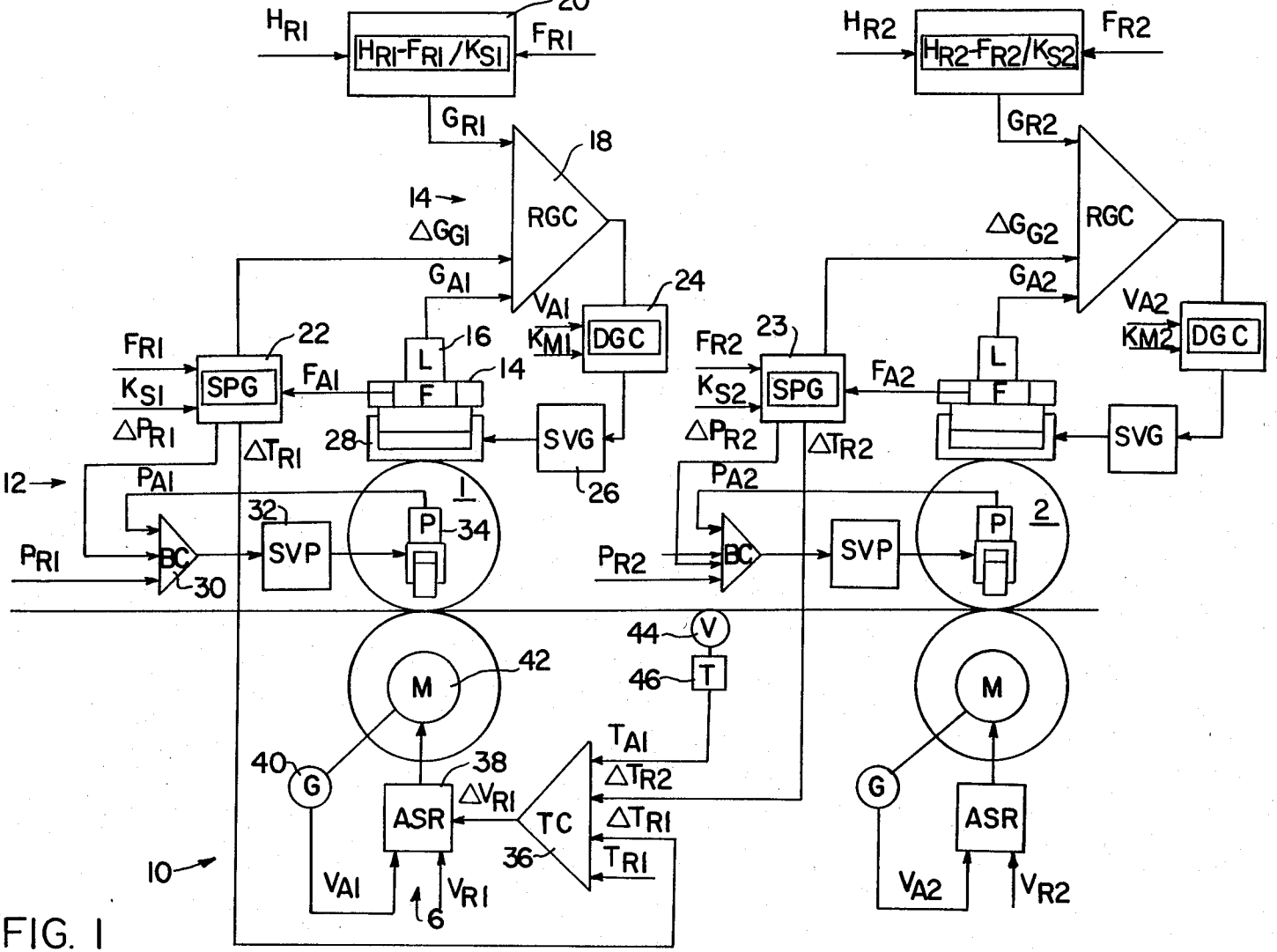
FIG. 1 is a schematic showing a pair of roll stands in a tandem mill and incorporating one embodiment of our combined automatic gauge control and strip profile control wherein tension is adjusted by speed control.

Referring to FIG. 1, our automatic gauge and strip profile control system as applied to a pair of tandem mill stands 1 and 2 comprises a tension loop 10, a roll bending loop 12 and a gauge meter loop 14. A speed control loop 6 is also associated with each stand. Each of the control loops (6, 10, 12 and 14) are closed-loop control systems seeking to reduce the difference between a reference signal and a process signal variable. However, the reference signals are themselves adjustable by correction signals from the digital automatic gauge and profile control 22.

The gauge meter loop 14 is standard and includes a digital computer 20 which outputs a no-load roll gap reference signal $G_{R1}$ for roll stand 1. The reference signal is based on the exit gauge reference $H_{R1}$ (desired thickness) for stand 1, the assumed roll separating force reference $F_{R1}$ for stand 1 and the mill spring constant for stand 1. The no-load roll gap reference $G_{R1}$ is calculated by use of the equation $G_{R1} = H_{R1} - F_{R1}/K_{S1}$. The roll gap reference $G_{R1}$ is combined with a roll gap correction signal $\Delta G_{G1}$ from strip profile and gauge meter controller 22 (to be explained) and compared with the actual no-load roll gap signal $G_{A1}$ from a cylinder position transducer 16 to produce a roll gap correction signal. The combination and comparison are made in roll gap controller 18. The position transducer L and the roll separating force transducer F are connected to the roll force hydraulic cylinder 28. The roll gap correction signal from controller 18 is applied to a digital dynamic gain controller 24 where the actual mill speed signal $V_{A1}$ and the material stiffness $K_{M1}$ at roll stand 1 is entered and the resultant signal is passed through a roll gap control servovalve 26 to the roll force hydraulic cylinder 28 where the gap correction is made to roll stand 1 (with increased $V_{A1}$ and/or $K_{M1}$ the gain is increased).

The roll bending loop 12 comprises a roll bending pressure controller (operational amplifier) 30 which combines a roll bend pressure reference signal $P_{R1}$ with a roll bending pressure correction reference $\Delta P_{R1}$ and compares the combined signal with the actual roll bend pressure $P_{A1}$ to produce a correction signal applied to a roll bending pressure control servovalve 32 which in turn acts on the roll bending equipment (not shown) associated with roll stand 1 in the standard manner. Roll bending pressure controller 30 receives the actual roll bending pressure signal $P_{A1}$ from a roll bending pressure transducer 34 associated with the roll bending equipment of mill stand 1. In addition, roll bending pressure controller 30 receives the roll bending pressure reference $P_{R1}$ for mill stand 1 from the computer and the roll bending pressure correction reference $\Delta P_{R1}$ from the strip profile and gauge meter controller 22.

The tension control loop 10 comprises a strip tension controller (operational amplifier) 36 which combines an interstand tension reference $T_{R1}$ and an interstand tension correction signal $\Delta T_{R1}$ and compares with the actual tension $T_{A1}$ (generated by tensiometer T) to produce a mill speed correction reference signal $\Delta V_{R1}$. This signal is applied to the speed control loop 6. The speed control loop 6 comprises an automatic speed regulator 38 to control the main drive motor 42 of mill stand 1 after the mill speed correction reference $\Delta V_{R1}$ is combined with the mill speed reference $V_{R1}$ for stand 1 and the actual mill speed $V_{A1}$ of the main drive motor 42 as determined by a tachogenerator 40.

The three loops 10,12 and 14 receive their respective correction signals from the digital strip profile and gauge meter controller 22 which receives a single dynamic process variable signal representative of the actual roll separating force obtained from roll separating force transducer 14. Controller 22 also stores the roll separating force reference $F_{R1}$ and mill spring $K_{S1}$ for roll stand 1 and is thus able to calculate roll gap correction signal $\Delta G_{G1}$, roll bending pressure correction reference $\Delta P_{R1}$ and the interstand tension correction reference $\Delta T_{R1}$.

The roll gap correction reference $\Delta G_{G1}$ will be calculated based upon the details of the particular stand. An example of a possible formula for making that correction is:

$$\Delta G_{G1} = \alpha_1 (F_{A1} - F_{R1}) / K_{S1}$$

where $\alpha_1$ is the mill stiffness factor.

The roll bending pressure correction reference $\Delta P_{R1}$ will be calculated based upon the particular type of roll bending apparatus used. Generally, crown is a function of both roll force and bending pressure, i.e., $C_1 = f(F_{A1}, P_{A1})$. Thus, a change in roll force will require a change in bending pressure.

The effect of interstand tension on roll force is well established and explained in the literature. Based on established relations, an increase in roll force can be compensated by a change in interstand tension correction reference $\Delta T_{R1}$.

It is desirable to compensate for any change in force at roll stand 1 by a change in interstand tension because that does not affect the strip profile. The strip profile and gauge meter controller 22 calculate the interstand tension correction reference $\Delta T_{R1}$ and this signal is transmitted into the strip tension controller (operational amplifier) 36 where the appropriate adjustment is made to the mill speed of the main motor drive 42. Preferably, at the same time, the strip profile and gauge meter controller 22 generate a roll gap correction signal $\Delta G_{G1}$ which is transmitted to the roll gap controller 18 for temporary roll gap correction. Since the tension loop 10 is slower than the gauge meter loop 14, the gauge meter loop makes the initial correction for a very short period measured in milliseconds and thereafter the slower responding tension loop 10 catches up to cancel the roll force increase. Thus, the roll force signal $F_{A1}$ immediately following a change and before the temporary gauge meter correction is used to maintain constant roll force by changing the interstand tension through loop 10.

Tension can only be controlled within reasonable limits and these limits are built into strip tension controller 36. When the demand tension signal from the controller 22 would exceed the tension limits, the excess correction of the roll force is absorbed by the gauge meter loop 14 through the roll gap correction signal $\Delta G_{G1}$. At the same time a pressure signal is generated to the servovalve 32 to compensate for the change in force by roll bending.

Figure 2:
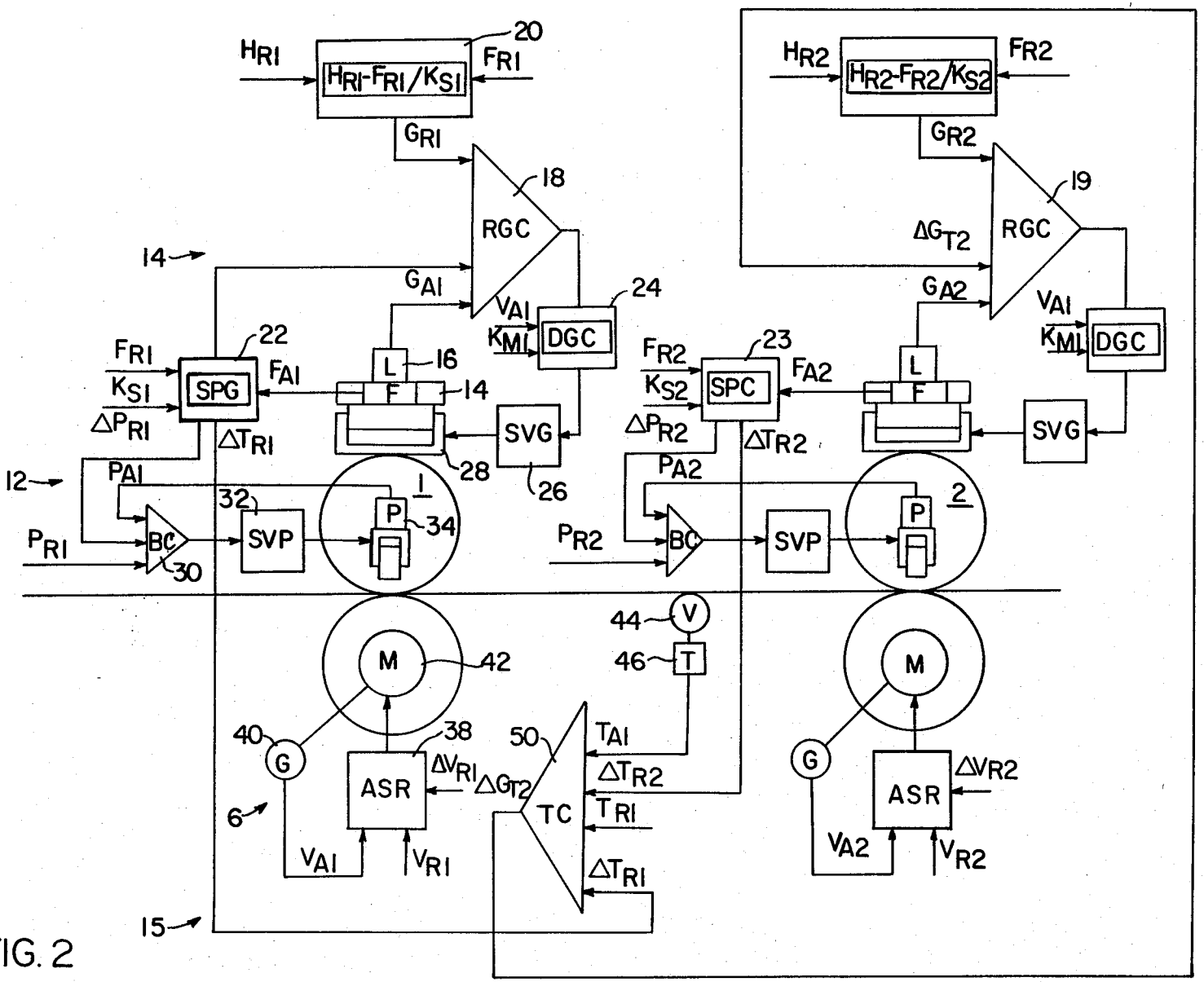
FIG. 2 is a schematic of a pair of roll stands in a tandem mill and incorporating another embodiment of our combined automatic gauge control and strip profile control wherein tension is adjusted by changing gap in the downstream stand.

The embodiment of FIG. 2 is identical to the embodiment of FIG. 1 in respect of the roll bending loop 12 and gauge meter loop 14. However, the tension loop 15 includes a strip tension controller 50 which controls tension by generating a roll gap correction signal $\Delta G_{T2}$ which is transmitted through roll gap controller 19 to control the gap setting of the downstream mill stand 2. The inputs into the strip tension controller 50 include the actual interstand tension $T_{A1}$ obtained through a tensiometer 46, an interstand tension reference $T_{R1}$ and an interstand tension correction reference $\Delta T_{R1}$ from the upstream strip profile and gauge meter 22 as well as $\Delta T_{R2}$ from strip profile and gauge meter 23 for the downstream roll stand 2. The embodiments of FIG. 1 and FIG. 2 are actually used together with the embodiment of FIG. 1 being employed during the threading of the strip and at slow speeds and thereafter when the strip is accelerated to a projected rolling speed the tension loop 10 of FIG. 1 is locked and the tension control is switched to the tension loop 15 illustrated in FIG. 2.

Figure 3:
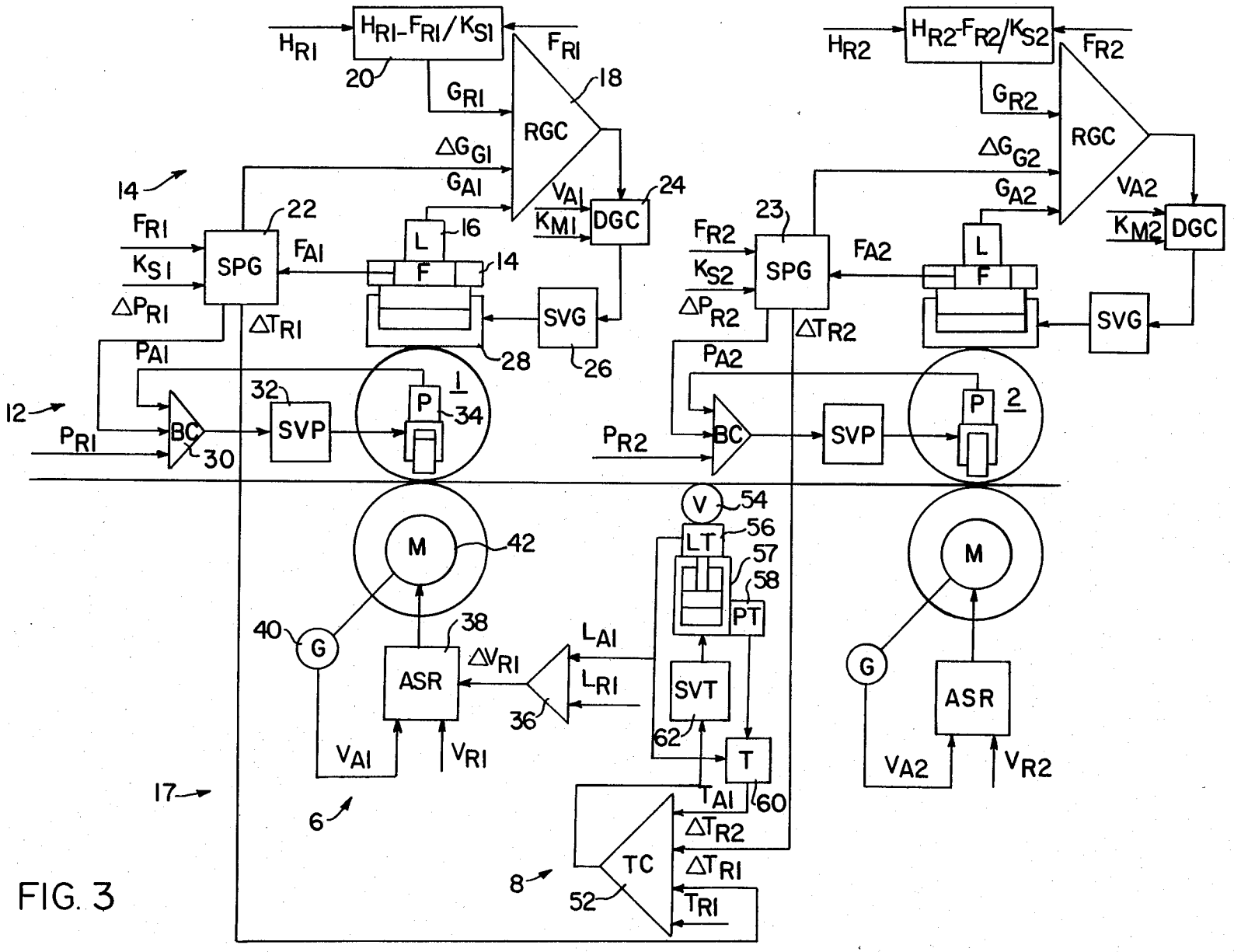
FIG. 3 is a schematic of a pair of roll stands in a tandem mill and incorporating still another embodiment of our combined automatic gauge control and strip profile control wherein tension is adjusted by both speed control and by a looper roll.

A preferred embodiment of the invention is illustrated in FIG. 3. It has an optimum response time both at threading and operating speeds. The roll bending loop 12 and the gauge meter loop 14 are identical to those described in the earlier embodiments. Tension loop 17 includes an interstand looper roll (not shown) which is operated by a hydraulic actuator 57 to move the strip vertically upward or downward from a set point to increase or decrease tension respectively. Such a looper roll is known in the art.

It also receives the interstand tension correction reference $\Delta T_{R1}$ from the strip profile controller 22. Tension controller 52 has applied thereto the interstand tension reference $T_{R1}$. Tension controller 52 further receives an interstand tension correction signal $\Delta T_{R2}$ from the strip profile and gauge meter controller 23 associated with the downstream stand 2. Finally, tension controller 52 receives the actual interstand tension signal $T_{A1}$. The actual interstand tension signal $T_{A1}$ is obtained from a tensiometer 60 which calculates tension after receiving looper roll position inpput from the strip tension cylinder position transducer 56 and the strip tension control pressure transducer 58. The amplified signal from the tension controller 52 acts through a strip tension control servovalve 62 to activate the hydraulic actuator 57 to cause a change in position of the looper roll to effect the interstand tension control.

At the same time the looper roll is caused to move from its set position to change the interstand tension the amount of movement is detected and is sent to speed loop 6 to adjust tension through speed so that the looper roll returns to its set point. Thus tension is only temporarily corrected by the looper roll. The looper position controller (operational amplifier) 36 compares the strip tension cylinder position reference $L_{R1}$ with the strip tension cylinder actual position signal $L_{A1}$ with the difference being converted to a mill speed correction reference $\Delta V_{R1}$ which forces the automatic speed regulator 38 to adjust speed. The mill speed correction reference $\Delta V_{R1}$ is combined with the mill speed reference $V_{R1}$ and compared with the actual mill speed signal $V_{A1}$ which is obtained through a tachogenerator 40 from the main drive motor 42. The automatic speed regulator 38 then adjusts the speed of the main motor drive 42 to bring the looper roll back to its set point.

The tension controller operates within established limits and when those limits would be exceeded by an increase in signal $\Delta T_{R1}$ from the strip profile and gauge meter controller 22, the gauge meter loop 14 and the roll bending pressure loop 12 are simultaneously activated to control gauge and ajust roll bending to compensate for resultant changes in force so as to maintain a constant strip profile.

All of the above embodiments include standard feed-forward and feed-back data inputs from x-ray gauge meters so that standard adjustments are made in the gauge meter loops. The initial mill set-ups are based on achieving the maximum rolling mill schedule production which is compatible with maintaining the required roll crown within the range of the roll bending system capabilities. No adjustment in rolling mill schedules need be made. In order to maintain the exit gauge tolerances and maintain the strip profile, the optimum static mill set-up references are established and dynamic correction of the various mill parameters are provided to offset disturbances introduced by the strip and mill. This dynamic correction takes place by utilizing the gauge meter signal first to maintain roll force by changing interstand tension and where a tension limit is achieved or saturated using the gauge meter signal to maintain gap control while simultaneously using the signal for roll bending to compensate for the force change and maintain a constant crown to thickness ratio.

We claim:

1. A method of combining automatic gauge control and strip profile control in a tandem rolling mill having at least an upstream and downstream four high roll stand with roll bending means comprising:

detecting a signal representative of the actual roll separating force in the upstream stand; and utilizing that signal to maintain a constant roll force in the upstream stand through interstand tension control within predetermined limits and where the limit would be exceeded utilizing said signal to simultaneously control the roll gap for gauge control and control the roll bending for strip crown control.

2. The method of claim 1 including providing a tension control loop for adjusting interstand tension, a gauge meter loop for controlling said roll gap and a roll bending pressure controller loop for controlling roll bending.

3. The method of claim 2 wherein the roll separating force signal simultaneously initiates the tension control loop and the gauge meter loop with the tension control loop being slower to respond than the gauge meter loop but catching up to cancel a roll force increase.

4. The method of claim 2 including providing an interstand tension loop connected to an automatic speed regulator for controlling the mill speed of one of the roll stands.

5. The method of claim 2 including providing an interstand tension loop connected to both an interstand looper roll and an automatic speed roll loop whereby tension is initially adjusted by adjusting pressure on the looper roll to change its position with respect to a set point and therafter the speed of one of the mill stands is adjusted for tension control so as to return the looper roll to said set point.

6. The method of claim 4 including providing a roll gap correction loop connected to the downstream stand whereby interstand tension can be controlled at threading speeds by the interstand tension loop and at operating speeds by the gap control loop.

7. A combination automatic gauge control and strip profile control for a rolling mill having at least an upstream and downstream tandem four high roll stand with roll bending means and screw down means associated therewith comprising:

a strip crown and gauge controller receiving a roll separating force signal from the upstream stand, comparing it to a reference force and generating a signal representing any difference between forces, said signal represented as an interstand tension correction signal, a strip tension controller receiving said interstand tension correction signal and adjusting the interstand tension to maintain a constant roll force on the upstream mill stand;

a gauge controller receiving a roll gap correction signal from the strip profile and gauge controller when the tension controller exceeds an established tension limit, said gap correction signal adjusting the screw down means to achieve the desired gauge; and a roll bending pressure controller receiving a roll bending signal simultaneous with the gap correction signal when the tension correction signal exceeds said established limits, said roll bending signal adjusting the roll bending means to compensate for changes in rolling forces from the screw down adjustment.

8. The combination of claim 6 including an automatic speed regulator associated with the main drive motor of the upstream stand receiving a mill speed correction reference signal from the strip tension controller, comparing it with a mill speed reference signal for that stand and generating a mill speed correction signal to the main drive motor.

9. The combination of claim 6 including an interstand looper roll adjusting a vertical position of a strip above or below a set position, said interstand tension correction signal activating said looper roll to adjust the vertical position of the strip to control tension used to thereafter adjust mill speed to control tension causing the looper roll to return to its set position.

* * * * *